United States Patent [19]

Oketani et al.

[11] Patent Number: 4,899,918

[45] Date of Patent: Feb. 13, 1990

[54] DISPENSING CARTON FOR A ROLL FILM

[75] Inventors: Isao Oketani; Yorio Takemura, both of Tokyo, Japan

[73] Assignee: Kurheha Chemical Industry Company Limited, Tokyo, Japan

[21] Appl. No.: 178,127

[22] Filed: Apr. 6, 1988

[30] Foreign Application Priority Data

Apr. 20, 1987 [JP] Japan ..... 62-60179[U]

[51] Int. Cl.[4] ..... B65D 85/67

[52] U.S. Cl. ..... 225/43; 225/49; 225/50

[58] Field of Search ..... 225/43, 39, 48, 49, 225/50, 91; 83/636, 649

[56] References Cited

U.S. PATENT DOCUMENTS

| | | | |
|---|---|---|---|
| 2,771,186 | 11/1956 | Burbank | 225/91 |
| 3,096,918 | 7/1963 | Van Dyke et al. | 225/48 |
| 3,542,268 | 11/1970 | Schramm | 225/91 X |
| 3,933,288 | 1/1976 | Struble | 225/48 X |
| 4,307,828 | 12/1981 | Sias et al. | 225/43 X |
| 4,426,029 | 1/1984 | Kamp | 225/43 X |
| 4,549,689 | 10/1985 | Bailey | 225/49 X |
| 4,579,267 | 4/1986 | Planke | 225/43 X |
| 4,646,956 | 3/1987 | Ruff et al. | 225/91 X |
| 4,648,537 | 3/1987 | Bättig | 225/43 |

FOREIGN PATENT DOCUMENTS 1037483 8/1983 Australia .

*Primary Examiner*—Frank T. Yost
*Assistant Examiner*—Rinaldi Rada
*Attorney, Agent, or Firm*—Koda & Androlia

[57] ABSTRACT

A dispensing carton in which a roll film is contained includes a box consisting of a bottom panel, a rear panel, a front panel, both side panels and an opening formed in an upper portion thereof, a lid member which is hingedly joined to an upper end of the rear panel, and a front flange joined to an end of the lid member to overlap the front panel when the lid member is closed. A cutter is provided in an end of the front flange and an intermediate portion of the cutter is protruded toward a base of the box. When the film pulled out from the box is led between the front flange and the front panel and is further pulled in the horizontal direction with the lid member being closed, the middle portion of the film is cut by the protruded portion of the cutter and the cutting operation of the film is advanced along the cutter so that the film is smoothly and completely cut into a slightly V-letter shape when the film is further pulled in the horizontal direction as it is. Thus, the cut film is fully spread horizontally without wrinkle and interwinement and the spread film can be used to cover a tray or the like.

5 Claims, 6 Drawing Sheets

DISPENSING CARTON FOR A ROLL FILM

BACKGROUND OF THE INVENTION

The present invention relates to a dispensing carton which contains a roll film used to wrap foodstuffs and can cut the film to dispense it.

More particularly, the present invention concerns a dispensing carton for a roll film which can cut the film by a cutter exactly only by pulling the film from the carton in the horizontal direction with respect to the carton.

Film used to wrap foodstuffs together with a tray on which the foodstuffs are put is wound into a roll and contained in a carton. A lid member of the carton includes a front flange connected continuously thereto and which is provided with a cutter. The film pulled from the carton is cut by the cutter to a desired length.

FIG. 8 is a perspective view showing a conventional dispensing carton for a roll film. A dispensing carton which is most analogous to the carton of FIG. 8 is disclosed in U.S. Pat. No. 4,307,828, for example.

In FIG. 8, numeral 1 denotes a dispensing carton formed into a rectangular parallelepiped. The carton 1 contains a film 30 wound about a core into a roll. A lid member 4 which covers an opening 3 of the carton 1 is joined to a rear panel 2 of the carton 1. The lid member 4 is formed at an end thereof with a flange 6 which overlaps a front panel 5. A metal cutter 7 is mounted to a tip of the flange 6. A tip of the cutter 7 is provided with a sawtooth edge which is slightly protruded from the tip of the flange 6 and extend in parallel with a base 1*a* of the carton.

The cutting operation of the film in the conventional dispensing carton is now described in detail. For convenience of the description, the rectangular coordinates X, Y and Z are superposed in the dispensing carton as shown in FIG. 9. The X-axis is a perpendicular axis to the surfaces of the rear panel 2 and the front panel 5 and the direction extending to the front panel 5 from the rear panel 2 is the positive direction of the X-axis while the direction extending to the rear panel 2 from the front panel 2 is the negative direction of the X-axis. The Y-axis is a perpendicular axis to the surfaces of side panels 8 and 9 and the direction extending to the side panel 9 from the side panel 8 is the positive direction of the Y-axis while the direction extending to the side panel 8 from the side panel 9 is the negative direction of the Y-axis. The Z-axis is the perpendicular direction to both of the X-and Y-axes and the direction extending to the opening 3 from the base 1*a* is the positive direction of the Z-axis while the direction extending to the base 1*a* from the opening 3 is the negative direction of the Z-axis.

The cutting operation in the conventional dispensing carton is described using the X, Y and Z axes defined above.

The dispensing carton is first held by the left hand and an end of the film 30 is then held by the right hand to pull out it in the positive direction of the X-axis in the X-Y plane. After the end of the film has been pulled out by a desired length as shown in FIG. 9, the corner of the film 30 near the position A shown in FIG. 9 is held by the right hand and is tensioned with a moderate tension T in the X-axis direction by both hands. A portion of the lid member 4 near the portion a shown in FIG. 9 is then depressed in the negative direction of the Z-axis by the left hand and the tension T given to the corner of the film near the portion A is slightly increased while the corner is slightly lifted in the positive direction of the Z-axis by the right hand. Consequently, an end of the film 30 is cut by a portion B of the cutter 7 and film 30 is further cut along the cutter 7 in the negative direction of the Y-axis. The cut film is used to wrap foodstuffs put on a tray. However, the above cutting operation possesses the following drawbacks.

It is desirable that the tray is covered by the film 30 fully opened along the X-Y plane. However, actually, when the tension T is slightly increased while the corner of the film is slightly lifted up in the positive direction of the Z-axis by the right hand at the same time that the portion a or its vicinity of the lid member is depressed in the negative direction of the Z-axis, the depressing operation in the negative direction of the Z-axis and the lifting operation of the positive direction of the Z-axis are often overlarge or the increased amount of the tension T is often overlarge. In such a case, the cut film 30 can not be kept opened fully along the X-Y plane and hence the film 30 held by the right hand is wrinkled or intertwined to be hung down so that an area of the film enough to cover the tray can not be obtained.

It is an object of the present invention to provide a dispensing carton in which a film pulled out therefrom can be cut smoothly and completely without wrinkle and intertwinement only by pulling out the film from the carton in the horizontal (X-axis) direction without lifting the pulled film in the positive direction of the Z-axis extremely.

It is another object of the present invention to provide a dispensing carton in which a film can be cut while fully spread horizontally and a tray is covered by the cut film fully spread without wrinkle and intertwinement.

SUMMARY OF THE INVENTION

According to the present invention, a dispensing carton in which a roll film is contained includes a box consisting of a bottom panel, a rear panel, a front panel, both side panels and an opening formed in an upper portion thereof, a lid member which is hingedly joined to an upper end of the rear panel, and a front flange joined to an end of the lid member to overlap the front panel when the lid member is closed. A cutter is provided in an end of the front flange and an intermediate portion of the cutter is protruded toward a base of the box. When the film pulled out from the box is led between the front flange and the front panel and is further pulled in the horizontal direction with the lid member being closed, the middle portion of the film is cut by the protruded portion of the cutter and the cutting operation of the film is advanced along the cutter so that the film is smoothly and completely cut into a slightly V-letter shape when the film is further pulled in the horizontal direction as it is. Thus, the cut film is fully spread horizontally without wrinkle and intertwinement and the spread film can be used to cover a tray or the like.

DETAILED DESCRIPTION OF THE PREFERRED EMBODIMENTS

Figure 1:
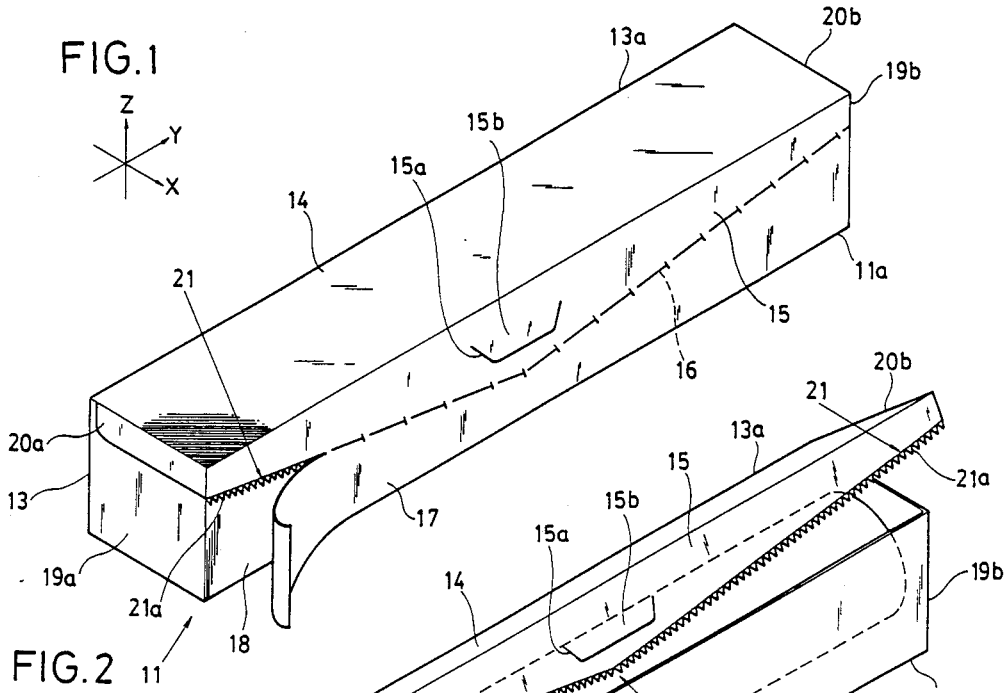
FIG. 1 is a perspective view of a dispensing carton, not opened, for a roll film according to the present invention.
Figure 2:
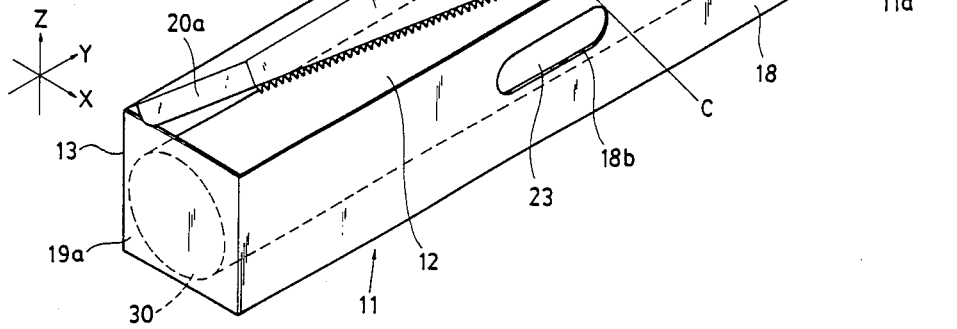
FIG. 2 is a perspective view of a dispensing carton, which has been opened, for a roll film according to the present invention.
Figure 3:
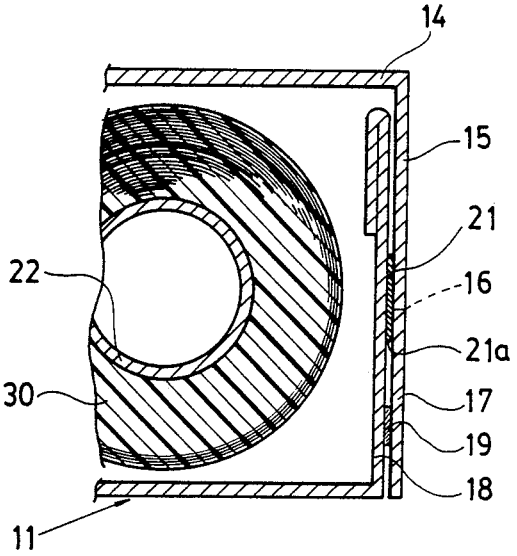
FIG. 3 is a sectional view showing a dispensing carton which has not been opened.
Figure 4:
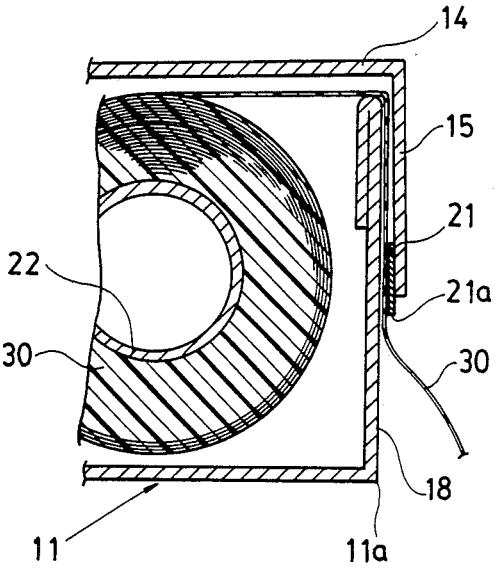
FIG. 4 is a sectional view showing a dispensing carton which has been opened and includes a lid member which is closed.

Referring to FIGS. 1 and 2, there is shown a dispensing carton 11 manufactured of paper. The carton 11 includes a rear panel 13, a front panel 18, side panels 19*a* and 19*b* and a bottom panel 11*a*, and is formed into a rectangular parallelepiped. The carton 11'includes an opening 12 formed in the upper portion thereof. A lid member 14 which covers the opening 12 is integrally joined to an upper end of the rear panel 13 of the carton 11. A front flange 15 is provided in a front end of the lid member 14 and further a tear strip 17 is formed in an end of the front flange 15 with a line of perforation 16 being formed between the front flange 15 and the tear strip 17. Both sides of the lid member 14 is formed with side flanges 20*a* and 20*b*. As shown in FIG. 3, before the carton is opened, the rear side of the tear strip 17 is joined to the front side of the front panel 18 at several spots with paste 19.

The carton 11 contains a film 30 wound on a core 22 into a roll. The film is made from, for example, synthetic resin such as vinylidene chloride copolymers, polyvinyl chloride or poly-butadiene.

A metal cutter 21 is mounted to a rear side of the end of the front flange 15. A tip of the cutter 21 is formed with a sawtooth edge 21*a* which is protruded from the end of the front flange 15 and is positioned behind the tear strip 17 in the state shown in FIGS. 1 and 3. The center C of the cutter 21 is protruded toward the base 11*a* of the carton 11. More particularly, as shown, in FIGS. 1 and 2, the center C of the cutter 21 is formed into a sharp point or edge and the sawtooth edges at the both sides of the center are tilted with respect to the base 11*a* of the carton 11 and extend straight. The center of the perforation line 16 constituting the boundary between the front flange 15 and the tear strip 17 is also protruded toward the base correspondingly and the front flange 15 is formed into a substantially triangular shape.

Figure 5:
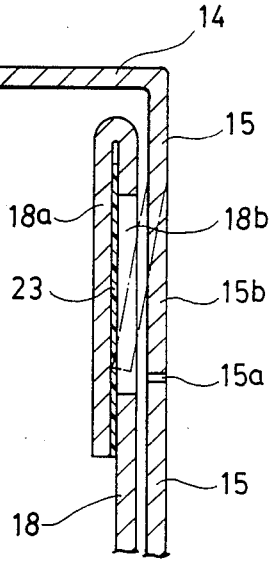
FIG. 5 is an enlarged sectional view of a film retainer provided in a front panel of the dispensing carton.

As shown in FIG. 5 on the enlarged scale, the front panel 18 includes an upper edge which is bent to the inside of the carton to from a bent portion 18*a* which is joined to the rear side of the front panel 18 with an adhesive tape 23. As shown in FIG. 2, the front panel 18 is formed with an opening 18*b* which constitutes film retaining means. The adhesive tape 23 is exposed from the film retainer 18*b*. The adhesive tape 23 exposed from the retainer 18*b* serves to hold the leading tip of the remaining film in the front of the front panel 18 when the film pulled out from the carton 11 has been cut by the cutter. A U-shaped cut or slit 15*a* is formed in the front flange 15 and a portion defined by the cut 15*a* constitutes a depressed piece 15*b* which can be deformed or bent inside the film retainer 18*b* as shown by a single-dotted broken line of FIG. 5. When the depressed piece 15*b* is held or pressed by a finger to cut the film 30 by the cutter 21, the depressed piece 15*b* is deformed inside and the film 30 pulled out in the front of the front panel 18 is pressed against the adhesive tape 23 in the film retainer 18*b* so that the film 30 is adhesively held by the adhesive tape 23.

For convenience of the description of the usage of the dispensing carton, the rectangular coordinates X, Y and Z are superposed in the dispensing superpose as shown in FIGS. 1, 2, 6 and 7. The X-axis is a perpendicular axis to the surfaces of the rear panel 13 and the front panel 18 and the direction extending to the front panel 18 from the rear panel 13 is the positive direction of the X-axis while the direction extending to the rear panel 13 from the front panel 18 is the negative direction of the X-axis. The Y-axis is a perpendicular axis to the surfaces of the side panels 19*a* and 19*b* and the direction extending to the side panel 19*b* from the side panel 19*a* is the positive direction of the Y-axis while the direction extending to the side panel 19*a* from the side panel 19*b* is the negative direction of the Y-axis. The Z-axis is the perpendicular direction to both of the X- and Y-axes and the direction extending to the opening 12 from the base 11*a* is the positive direction of the Z-axis while the direction extending to the base 11*a* from the opening 12 is the negative direction of the Z-axis.

The usage of the dispensing carton according to the embodiment is now described using the X, Y and Z axes defined above.

When the carton is opened, the tear strip 17 joined to the front panel 18 of the carton 11 is stripped off and separated from the front flange 15 along the perforation line 16. When the tear strip 17 has been removed, the sawtooth edge 21*a* of the cutter 21 is exposed or protruded from the end of the front flange 15 as shown in FIG. 2. After the removal of the tear strip 17, the upper end 13*a* of the rear panel 13 of the carton 11 serves as a hinge so that the lid member 14 and the front flange 15 can be opened and closed with respect to the opening 12 of the carton 21.

Figure 6:
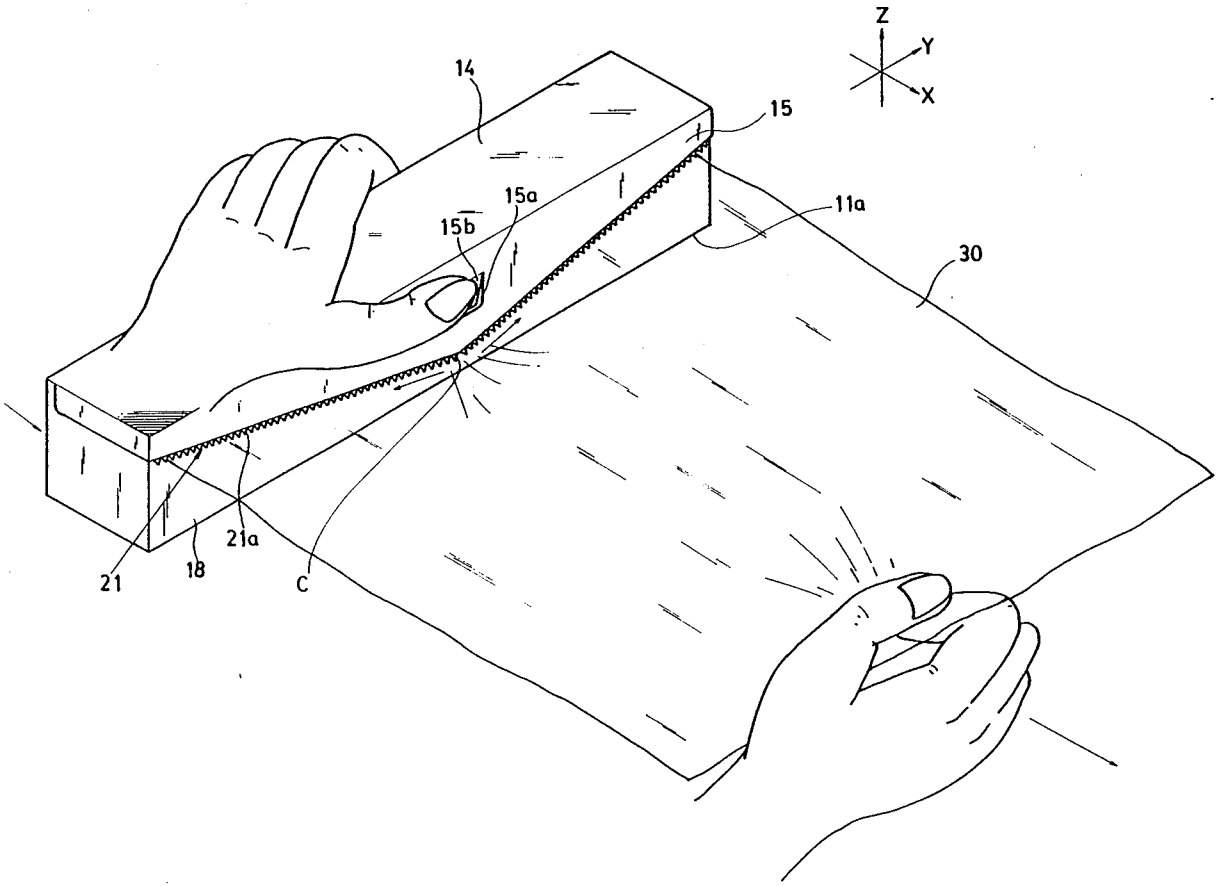
FIG. 6 is a perspective view showing the dispensing carton from which a film is pulled out to be cut.

After the carton has been opened, the film 30 wound on the core 22 is pulled out between the front panel 18 and the front flange 15. After the film 30 has been pulled out by a desired length, the dispensing carton is held by the left hand and the front flange 15 is held or pressed by the thumb, for example, as shown in FIG. 6. Alternatively, the lid member 14 may be held by the thumb. Further, the film 30 is held at the central tip thereof by the right hand. The sawtooth edge 21*a* of the cutter 21 protruded from the end of the front flange 15 includes the center C formed into the protruded edge, and accordingly when the central tip of the film 30 is pulled out in the positive direction of the X-axis by the right hand, the middle portion of the film 30 is cut by the center C of the sawtooth edge 21*a*. When the film 30 is further pulled out in the positive direction of the X-axis as it is, the cut operation of the film is advanced in the direction toward both sides of the film along the sawtooth edge 21*a* so that the film 30 is cut smoothly and completely into the slightly V-letter shape. Thus, since the film 30 can be cut only by pulling the film in the positive direction of the X-axis with respect to the carton, any wrinkle is not formed in the cut film 30 or the film is not joined to each other with intertwinement. Accordingly, if the cut film 30 held by the right hand is lowered to an object to be wrapped such as foodstuffs and a tray as it is, the cut film 30 which has been spread substantially horizontally (in the X-Y plane) with a sufficient area is put on the object such as the tray.

The foregoing is the usage of the dispensing carton according to the present invention.

Furthermore, when the film 30 is cut in the state of FIG. 6 while the pressed piece 15*b* formed in the front flange 15 is held or pressed by the thumb of the left hand, the film 30 positioned behind the pressed piece 15*b* can be pressed within the film retainer 18*b* formed in the front panel 18 through the pressed piece 15*b*. Accordingly, the film 30 remaining between the front flange 15 and the front panel 18 after the film has been completely cut is held by the adhesive tape 23 in the film retainer 18*b*. Thus, it can be prevented that the film 30 is rewound into the carton 11 after the film has been cut to wrap the foodstuffs and the tray.

Figure 7:
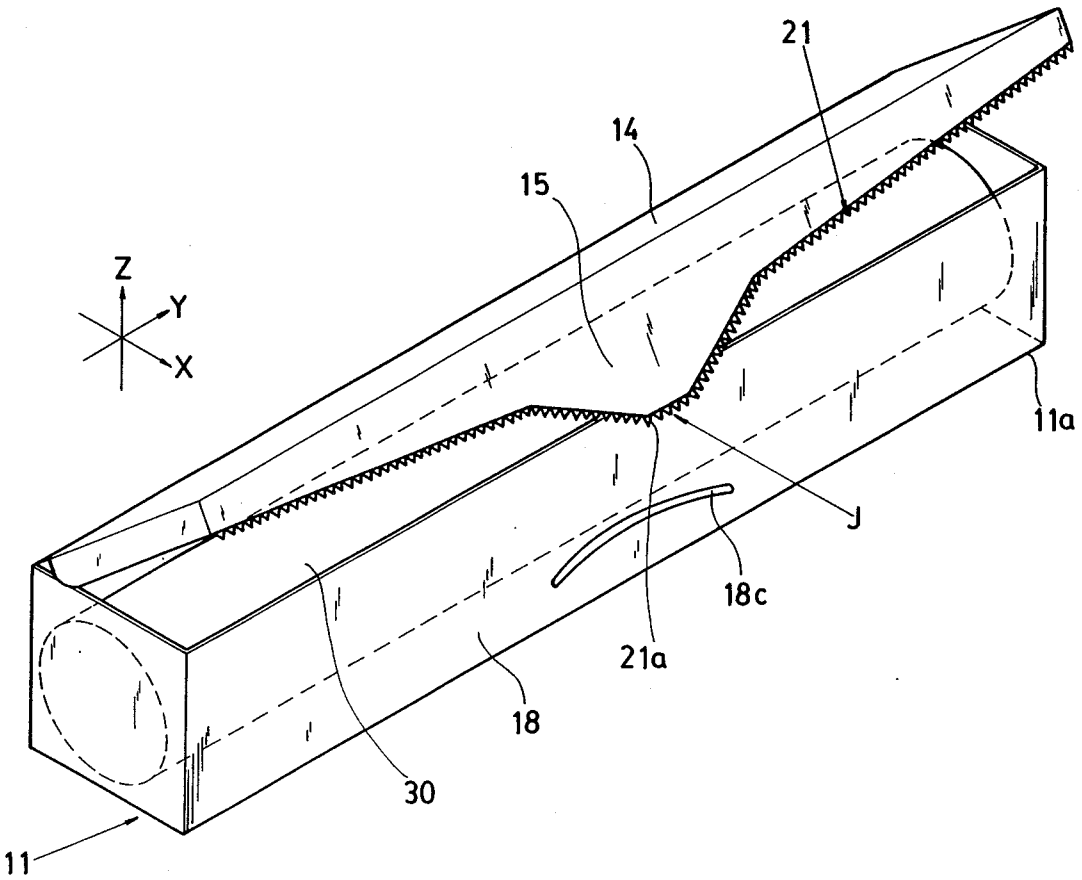
FIG. 7 is a perspective view showing another structure of a dispensing carton for a roll film according to the present invention.
Figure 8:
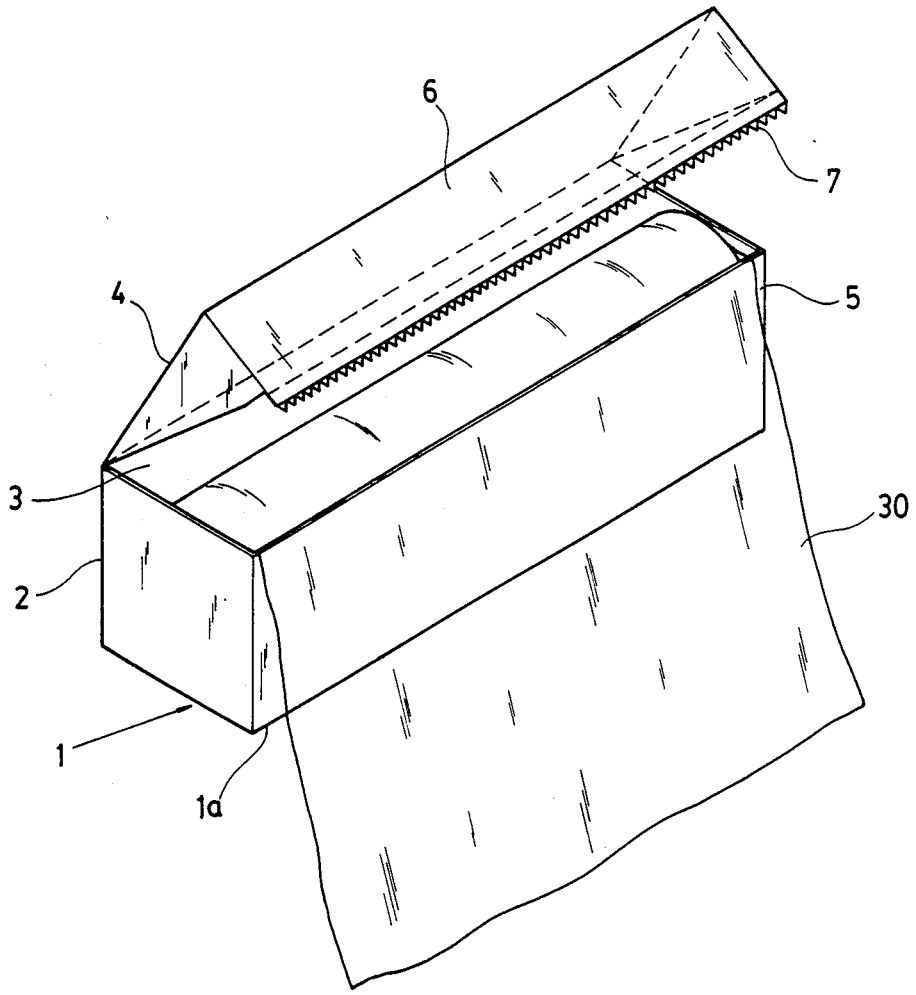
FIG. 8 (Prior Art)
FIG. 8 is a perspective view showing a conventional dispensing carton for a roll film.
Figure 9:
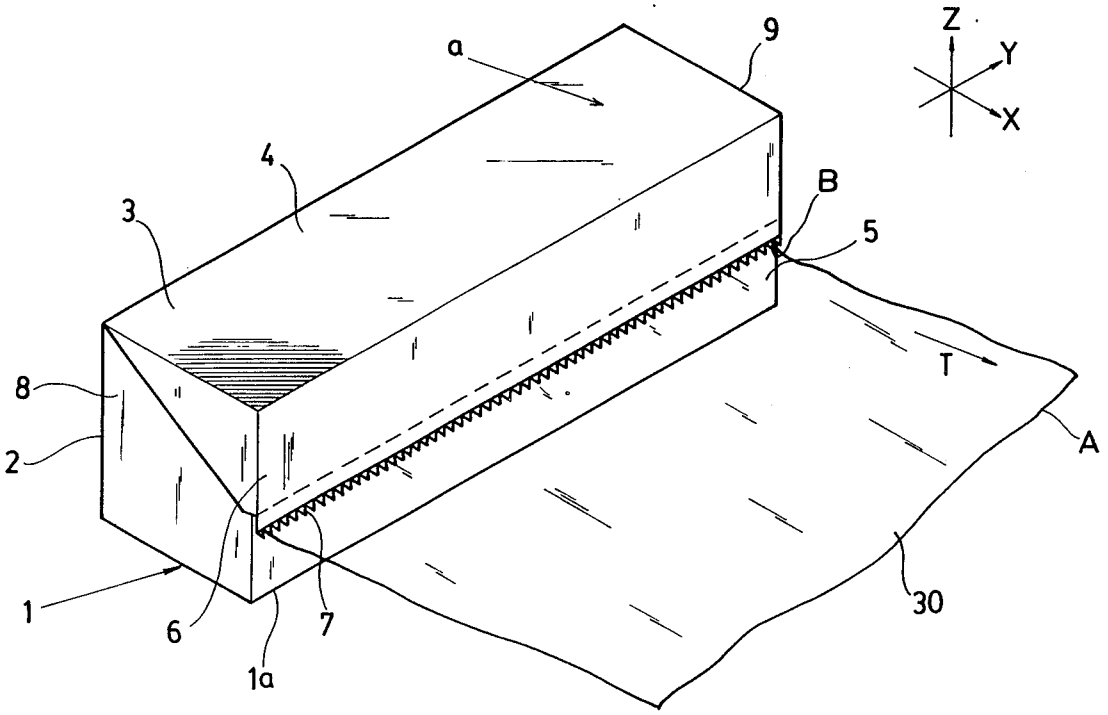
FIG. 9 (Prior Art)
FIG. 9 is a perspective view showing a conventional dispensing carton for a roll film in which the film is to be cut.

FIG. 7 shows another embodiment, in which the front flange 15 and the cutter mounted thereto include a center which is protruded into a substantially trapezoid shape. In this case, the cutting operation of the film 30 is performed in the same manner as shown in FIG. 6. Namely, a middle portion of the film 30 is cut by the sawtooth edge 21*a* positioned in the protruded portion J in the form of trapezoid and the film is smoothly and completely cut only by pulling the central end of the film in the positive direction of the X-axis. Further, the front panel 18 of the carton 11 is formed with a substantially arcuated cut or slit 18*c*. After the film has been cut by a desired length, the protruded portion J can be inserted into the cut 18*c*. Accordingly, when the dispensing carton is not used, the lid member 14 can be prevented from being opened.

In the embodiments, while the cutter 21 is formed into the substantially triangular or trapezoid shape, the cutter 21 may be formed into an arcuated shape and the central portion thereof may be protruded toward the base 11*a* of the carton 11.

It is not always necessary to provide the protruding central edge C shown in FIG. 2 or the protrusion J shown in FIG. 7 in the center of the cutter 21 and it may be provided in any eccentric position in the longitudinal direction of the carton.

As described above, according to the present invention, since the cutting edge provided in the end of the front flange is protruded, the middle portion of the film is first cut by the protruded edge only by pulling the film in the positive direction of the X-axis without lifting the film pulled out from the carton in the X-Y plane in the positive direction of the Z-axis, and then the cut operation of the film is advanced in the direction toward both sides of the film along the sawtooth edge so that the film is cut smoothly and completely into the slightly V-letter shape. Accordingly, any wrinkle is not formed in the cut film and the cut film is not joined to each other with intertwinement. It is not necessary to spread the cut film in the X-Y plane by both hands and the cut film can be used to wrap the object such as the tray as it is.

We claim:

1. A dispensing carton in which a roll of film is contained comprising a box including a bottom panel, a rear panel, a front panel, both side panels and an opening formed in an upper portion of the front panel, a lid member which is hingedly joined to the rear panel, a front flange joined to an end of said lid member to overlap said front panel when said lid member is closed, said front flange formed into a triangle which protrudes downwardly to a base of said box and a tear strip provided continuously on and integrally with an edge of said front flange with said tear strip separated from the front flange by a V-shaped perforation line, a cutting member provided on said V-shaped edge of said front flange and including a saw toothed edge which is lined up along said V-shaped edge and said tear strip and said saw tooth edge are arranged and configured such that when said tear strip is separated from said front flange, the teeth of said saw tooth edge are exposed along said V-shaped edge of said front flange.

2. A dispensing carton according to claim 1, wherein said cutting member is made of metal.

3. A dispensing carton in which a roll of film is contained comprising a box including a bottom panel, a rear panel, a front panel, both side panels and an opening formed in an upper portion of the front panel, a lid member which is hingedly joined to the rear panel, a front flange joined to an end of said lid member to overlap said front panel when said lid member is closed, said front flange formed into a triangle with an intermediate portion on the form of a trapezoid which protrudes downwardly to a base of said box and a tear strip provided continuously on and integrally with an edge of said front flange with said tear strip separated from the front flange by a perforation line, a cutting member provided on said edge of said front flange along said triangle and said intermediate trapezoidal portion and including a saw tooth edge which is lined up along said edge of said front flange and said tear strip and said saw tooth edge are arranged and configured such that when said tear strip is separated from said front flange, the teeth of said saw tooth edge are exposed along said edge of said front flange.

4. A dispensing carton according to claim 3, wherein said trapezoid portion of said cutting member is formed in the middle of said cutting member.

5. A dispensing carton according to claim 3, wherein said front panel of said box is formed with a cut for receiving the trapezoid portion of said cutting member.

* * * * *

UNITED STATES PATENT AND TRADEMARK OFFICE

CERTIFICATE OF CORRECTION

PATENT NO. : 4,899,918

DATED : February 13, 1990

INVENTOR(S) : Isao Oketani, et al

It is certified that error appears in the above-identified patent and that said Letters Patent is hereby corrected as shown below:

On the title page:

Column [73] Assignee: Change "Kurheha Chemical Industry Company Limited, Tokyo, Japan" to --Kureha Chemical Industry Company Limited, Tokyo, Japan--

Signed and Sealed this

Twenty-ninth Day of January, 1991

*Attest:*

*Attesting Officer*

HARRY F. MANBECK, JR.

*Commissioner of Patents and Trademarks*